US006168153B1

(12) United States Patent
Richards et al.

(10) Patent No.: US 6,168,153 B1
(45) Date of Patent: Jan. 2, 2001

(54) PRINTER SHEET DESKEWING SYSTEM WITH AUTOMATICALLY VARIABLE NUMBERS OF UPSTREAM FEEDING NIP ENGAGEMENTS FOR DIFFERENT SHEET SIZES

(75) Inventors: Paul N. Richards; Lawrence R. Benedict, both of Fairport; Brian R. Ford, Walworth; David A. D'Angelantonio, Webster, all of NY (US)

(73) Assignee: Xerox Corporation, Stamford, CT (US)

( * ) Notice: Under 35 U.S.C. 154(b), the term of this patent shall be extended for 0 days.

(21) Appl. No.: 09/312,999

(22) Filed: May 17, 1999

(51) Int. Cl.[7] ..... B65H 7/02; B65H 9/00
(52) U.S. Cl. ..... 271/227; 271/226; 271/228
(58) Field of Search ..... 271/226, 227, 271/228, 229, 259, 261, 265.01, 265.02

(56) References Cited

U.S. PATENT DOCUMENTS

| | | | | |
|---|---|---|---|---|
| 4,621,801 | | 11/1986 | Sanchez | 271/251 |
| 5,140,166 | * | 8/1992 | Gerlier | 271/227 X |
| 5,678,159 | | 10/1997 | Williams et al. | 399/395 |
| 5,689,759 | * | 11/1997 | Isemura et al. | 271/265.02 X |
| 5,697,608 | * | 12/1997 | Castelli et al. | 271/228 |
| 5,715,514 | | 2/1998 | Williams et al. | 399/395 |
| 5,890,708 | * | 4/1999 | Song | 271/259 X |
| 5,918,876 | | 7/1999 | Maruyama et al. | 271/228 |
| 5,918,877 | * | 7/1999 | Takei et al. | 271/261 |

* cited by examiner

*Primary Examiner*—Christopher P. Ellis
*Assistant Examiner*—Gene O. Crawford

(57) ABSTRACT

A sheet handling system for a sheet transport path of a reproduction apparatus having a sheet skew correction system being fed image substrate sheets in the process direction by a sheet transport system, wherein it is desired to positively feed and yet effectively deskew a wide range of different lengths of sheets in the process direction. A plurality of identical but independent sheet transport units may be provided spaced along the sheet transport path in the process direction engageable with a sheet being fed through sheet transport path for positively feeding even very short sheets from one sheet transport unit to another and to the skew correction system. Yet these sheet transport units provide independently automatically disengageable nips for automatically releasing even a very long sheet from any unit when that long sheet is in the skew correction system. A different selected number of the sheet transport units are disengaged in response to a different sheet length control signal. A single stepper motor rotating a common camshaft in each unit may be used to reliably lift all the idlers of all the nips to be disengaged.

11 Claims, 6 Drawing Sheets

PRINTER SHEET DESKEWING SYSTEM WITH AUTOMATICALLY VARIABLE NUMBERS OF UPSTREAM FEEDING NIP ENGAGEMENTS FOR DIFFERENT SHEET SIZES

Cross-referenced, with a similar disclosure, is an inventor-related U.S. patent application Ser. No. 09/312,675 by the same assignee, filed on the same date as this application, and entitled "PRINTER SHEET DESKEWING SYSTEM WITH AUTOMATIC VARIABLE NIP LATERAL SPACING FOR DIFFERENT SHEET SIZES".

Disclosed in the embodiment herein is an improved system for controlling, correcting and/or changing the position of sheets traveling in a sheet transport path, in particular, for automatic sheet skew correction and/or side registration of a wider range of different sizes of paper or other image bearing sheets in or for an image reproduction apparatus, such as a high speed electronic printer, to provide deskewing and/or side registration of much longer sheets without losing positive sheet feeding control over much shorter sheets, including subsequently fed sheets in the sequence of sheets in the sheet path. This may include deskewing and/or side registration of sheets being initially fed in to be printed, sheets being recirculated for second side (duplex) printing, and/or sheets being outputted to a stacker, finisher or other output or module.

More specifically disclosed in the embodiment herein is a system and method for automatically engaging or disengaging an appropriate number of sequential plural spaced sheet feed-in nips of the sheet transport in the sheet path into the sheet deskewing system in accordance with a control signal corresponding to the length of the sheet to be deskewed and/or laterally registered. [The sheet "length" here is the sheet dimension in the sheet feeding or sheet movement direction of the sheet path, otherwise known as the "process direction", as such terms may be used in the art in that regard, even though, as is well known, smaller sheets are often fed "long edge first", rather than lengthwise, whereas in contrast very large sheets are more often fed lengthwise. Sheet "width" as referred to herein is thus the orthogonal sheet dimension as the sheet is being fed, i.e., the sheet dimension transverse to the sheet path and the sheet movement direction.

As shown in the embodiment example, these features and improvements can be accomplished in one exemplary manner by automatically disengaging, from a long sheet being deskewed, a sufficient sequential number of upstream sheet feeding units to allow the deskewing of that long sheet, the number disengaged depending on the length of the sheet. Yet positive nip feeding engagement of the next adjacent upstream sheet being fed can be simultaneously maintained while its closely immediately preceding sheet is being deskewed, even for very short sheets.

As shown in this example, this different selectable disengagement of otherwise engaged nips sheet feeding units may even be simply and reliably provided by variable control of a plurality of otherwise structurally identical units. As also disclosed in this example, controlled partial rotation of respective nip idler engagement control cams by the controlled partial rotation of a stepper motor can be utilized for reliable sheet feeding nip disengagement or engagement in each unit. That control may even be provided as shown by a single stepper motor with plural cams on a common shaft variably controlling all of the plural spaced idlers of all of the plural spaced non-skew sheet feeding nips. That can provide better control and long-term reliability than trying to hold individual nips open or closed by activation, deactivation, or holding, of individual solenoid actuators for each nip.

The above-described embodiments (or other embodiments of the generic concept) can greatly assist in automatically providing more accurate and rapid deskewing rotation and/or edge registration of a very wide range of sheet sizes, from very small sheets to very large sheets, and from thin and flimsy such sheets to heavy or stiff such sheets. This is accomplished in the disclosed embodiment by a simple, low cost, fixed position, system which does not require repositioning of any of the system components relative to the paper path, only automatically selected different nip engagements in different positions of the paper path.

The present system is particularly well suited for cooperation and combination with an automatic deskewing an side registration system of the known general type comprising a differentially driven spaced pair of sheet deskewing nips, for which references are cited below. [In another disclosed feature of this specification, which is the subject of the above cross-referenced related application, the spacing between a pair of such operative deskewing nips can be automatically changed between a spacing more suitable for large sheets and another spacing more suitable for small sheets.]

Examples of such prior art type of (fixed spacing) dual differently driven nips systems for automatic deskewing and side registration of the sheets to be accurately imaged in a printer, including the appropriate controls of the differently driven sheet steering nips, and including cooperative arrayed sheet edge position detector sensors and signal generators, are already fully described and shown, for example, in prior Xerox Corp. U.S. Pat. Nos. 5,678,159 and 5,715,514 by Lloyd A. Williams, et al., and other patents cited therein, all of which are incorporated herein. Accordingly, that subject matter per se need not be re-described in detail herein. As explained therein, by driving two spaced apart steering nips with a speed differential to partially rotate a sheet for a brief predetermined time, as the sheet is also being driven forward by both nips, so that it is briefly driven forward at an angle, and then reversing that relative difference in nip drive velocities, the sheet can be side-shifted into a desired lateral registration position, as well as correcting any skew that was in the sheet as the sheet entered the steering nips, i.e., straightening out the sheet so that the sheet exits the steering nip pair aligned in the process direction as well as side registered.

The improved system disclosed herein is also desirably compatible and combinable with an elongated and substantially planer sheet feeding path upstream in the paper path from the subject deskewing and/or side registration system station, leading thereto, along which the subject sheet feeding units here are spaced. Such a long and planar sheet feeding path to the deskewing system reduces resistance to sheet rotation and/or lateral movement, especially for large, stiff, sheets. That is, a planar sheet entrance path longer than the longest sheet to be deskewed, to allow deskewing rotation of even very large and stiff sheets while those sheet are planar, rather than a path that bends sheets to cause sheet beam strength normal forces pressing against the path baffles, thus reducing any tendency for that to cause excessive resistance and/or scuffing or slippage by both the sheet feeding nips and the deskewing or steering nips.

As further disclosed in the embodiment herein, the subject improved sheet input feeding system in the upstream sheet feeding path provides for the automatic release or disengagement of a selected variable number (from 1 to 3 in the illustrated embodiment) of plural upstream sheet feeding plural nip stations or units spaced apart along the sheet path upstream of the sheet deskewing station. That selected release is automatic, and may be in response to a sheet length control signal (such as a signal from a sensor or other signal generator indicative of the approximate sheet dimension along or in the process or sheet path movement direction). The spacings and respective actuations (releases or engagements) of the selected number of plural sheet feeding nips along the upstream sheet path of that sheet path control system can provide for a wide range of sheet lengths to be positively fed, without loss of positive nip control, even short sheets, downstream to the automatic deskewing and/or side registration system. Yet once a sheet is acquired in the steering nips of the deskew system a sufficient number of said upstream sheet feeding nips can be automatically released or opened to allow for unrestrained sheet rotation and/or lateral movement by the subject system, even of very long sheets. As is well know in the art, standard sizes of larger size sheets are both longer and wider, and are often fed short-edge first or lengthwise, and thus are very long sheets in the process direction. This related cooperative automatic system also helps provide for automatic proper deskewing and/or edge registration of very small sheets, with positive feeding of even very small sheets, even with small pitch spacings and higher page per minute (PPM) rates, yet with positive feeding nip engagement of such small sheets in the same sheet input path and system as for such very large sheets.

In reference to the above, as taught, for example, in Xerox Corp. U.S. Pat. No. 4,621,801 issued Nov. 11, 1986 to Hector J. Sanchez (see especially the middle of Col. 17), it is known to release a single upstream sheet feeding nip to allow a downstream document sheet deskewing and side registration nip system to rotate (to deskew) and/or side shift the sheet. However, that only is effective for a limited range of sheet lengths. If that single releasable upstream sheet feeding nip is spaced too far away from the downstream sheet deskewing and side registration nip it cannot positively feed any sheets of lesser dimensions than that spacing. If on the other hand that single releasable upstream sheet feeding nip is spaced too far downstream it may be too far away from the next further upstream non-releasable sheet feeding nip in the sheet path. Yet if that next further upstream sheet feeding nip is positioned too far downstream it will not release the rear or trailing edge portion of long sheets in time—before the leading edge of that same long sheet is in the downstream sheet deskewing and side registration nip which is trying to rotate and/or side shift that sheet.

Another disclosed feature and advantage illustrated in the disclosed embodiments is that both of said exemplary cooperative systems disclosed therein, the plural positive sheet feeding units and the deskewing system unit, can all share a high number and percentage of identical or almost identical components, thus providing significant design, manufacturing, and servicing cost advantages.

The above and other features and advantages allow for accurate registration for imaging of a wider variety of image substrate sheet sizes. In reproduction apparatus in general, such as xerographic and other copiers and printers or multifunction machines, it is increasingly important to be able to provide faster yet safer and more reliable, more accurate, and more automatic, handling of a wide variety of the physical image bearing sheets, typically paper (or even plastic transparencies) of various sizes, weights, surfaces, humidity, and other conditions. Elimination of sheet skewing or other sheet misregistration is very important for proper imaging. Otherwise, borders and/or edge shadow images may appear on the copy sheet; and/or information near an edge of the image may be lost. Sheet misregistration or misfeeding can also adversely affect further sheet feeding, ejection, and/or stacking and finishing.

Further by way of background, various types of variable or active, as opposed to passive, sheet side shifting or lateral registration systems are known in the art. It is particularly desirable to be able do so "on the fly", without stopping the sheets, while the sheet is moving through or out of the reproduction system at a normal process (sheet transport) speed. In addition to the two sheet side registration systems patents cited above providing combined sheet deskewing, the following patent disclosures, and other patents cited therein are noted by way of some other examples of active sheet lateral registration systems with various means for side-shifting or laterally repositioning the sheet: Xerox Corporation U.S. Pat. No. 5,794,176 issued Aug. 11, 1998 to W. Milillo; 4,971,304 issued Nov. 20, 1990 to Lofthus; 5,156,391 issued Oct. 20, 1992 to G. Roller; 5,078,384 issued Jan. 7, 1992 to S. Moore; 5,094,442 issued Mar. 10, 1992 to D. Kamprath, et al; 5,219,159 issued Jun. 15, 1993 to M. Malachowski et al; 5,169,140 issued Dec. 8, 1992 to S. Wenthe; and 5,697,608 issued Dec. 16, 1997 to V. Castelli, et al.. Also, IBM U.S. Pat. No. 4,511,242 issued Apr. 16, 1985 to Ashbee, et al. The present sheet handling system can also be used with many of these other deskewing systems.

Note that in some reproduction situations, it may even be desired to deliberately provide a substantial, but controlled, sheet side-shift, varying with the sheet's lateral dimension, even for sheets that do not enter the system skewed, such as in feeding sheets from a reproduction apparatus with a side registration system into a connecting finisher having a center registration system. Or, in duplex printing, for providing appropriate or desired side edge margins on the inverted sheets being recirculated for their second side printing after their first side printing. The present system can also be utilized in combination with those other sheet side-shifting systems, which may be generally encompassed by the term "sheet deskewing system" or "skew correction system" as used in the claims herein.

Merely as examples of the variety and range of even standard sheet sizes used in printing and other reproduction systems, in addition to well-known standard sizes with common names such as "letter" size, "legal" size, "foolscap", "ledger" size, A-4, B-4, etc., there are very large standard sheets of uncut plural such standard sizes, such as 14.33 inch (36.4 cm) wide sheets, which are 20.5 inches (52 cm) long, or even larger sheets. Such very large sheets can be used, for example, for single image engineering drawings, or printed "4-up" with 4 letter size images printed thereon per side and then sheared or cut into 4 letter size sheets, thus quadrupling the effective PPM printing or throughput rate of the reproduction apparatus, and/or folded into booklet, Z-fold, or map pages. The disclosed systems can effectively handle such very large sheets. Yet the same systems here can also effectively handle much smaller sheets such as 5.5 inch (14 cm) by 7 inch (17.8 cm) or 7 inch (17.8 cm) by 10 inch (25.4 cm) sheets. Some other common standard sheet sizes are listed and described in the table below.

Common Standard Commercial Paper Sheet Sizes

| Size Description | Size in Inches | Size in Centimeters |
|---|---|---|
| 1. U.S. Government (old) | 8 × 10.5 | 20.3 × 26.7 |
| 2. U.S. Letter | 8.5 × 11 | 21.6 × 27.9 |
| 3. U.S. Legal | 8.5 × 13 | 21.6 × 33.0 |

-continued

Common Standard Commercial Paper Sheet Sizes

| Size Description | Size in Inches | Size in Centimeters |
|---|---|---|
| 4. U.S. Legal | 8.5 × 14 | 21.6 × 35.6 |
| 5. U.S. Engineering | 9 × 12 | 22.9 × 30.5 |
| 6. ISO* B5 | 6.93 × 9.84 | 17.6 × 25.0 |
| 7. ISO* A4 | 8.27 × 11.69 | 21.0 × 29.7 |
| 8. ISO* B4 | 9.84 × 13.9 | 25.0 × 35.3 |
| 9. Japanese B5 | 7.17 × 10.12 | 18.2 × 25.7 |
| 10. Japanese B4 | 10.12 × 14.33 | 25.7 × 36.4 |

*International Standards Organization

A specific feature of the specific embodiments disclosed herein is to provide a sheet handling method for correcting the skew of sequential image substrate sheets to be moved downstream in a process direction in a sheet transport path for a reproduction apparatus, in which selected said image substrate sheets are deskewed by being partially rotated by a sheet deskewing system, the improvement for increasing the operative range of effective deskewing of image substrate sheets of different lengths in said process direction, from a preset short sheet length to a very much greater sheet length, comprising; obtaining a control signal proportional to said sheet length in said process direction of an image substrate sheet in said sheet transport path, providing a plurality of spaced apart sheet feeding nip sets of plural sheet feeding nips upstream from said sheet deskewing system in said sheet transport path, said plurality of spaced apart sheet feeding nip sets being spaced apart from one another and from said sheet deskewing system in said process direction by less than said preset short sheet length so as to be capable of providing positive sheet feeding of said preset short sheet lengths as well as longer sheet lengths in said process direction, sequentially positively feeding all of said image substrate sheets in said process direction downstream in said sheet transport path into said sheet deskewing system with said plurality of spaced apart sheet feeding nip sets, said plurality of spaced apart sheet feeding nip sets being selectably individually disengageable from an image substrate sheet moving in said process direction in said sheet transport path by opening said sheet feeding nips thereof, and automatically disengaging a selected plural number of said plurality of spaced apart upstream sheet feeding nip sets in response to said control signal proportional to said sheet length of said image substrate sheet moving in said process direction in said sheet transport path when said image substrate sheet is in said sheet deskewing system and before said image substrate sheet is deskewed by being partially rotated by said sheet deskewing system so that said upstream sheet feeding nip sets are disengaged from said image substrate sheet as said image substrate sheet is being deskewed, even for an image substrate sheet of said much greater sheet length, while a subsequent image substrate sheet moving in said process direction in said sheet transport path may be positively fed by at least one of said plurality of spaced apart sheet feeding nip sets.

Further specific features disclosed herein, individually or in combination, include those wherein said plural sheet feeding nips of said sheet feeding nip sets comprise plural drive wheels and plural mating idlers disengageable by plural rotatable cams, and wherein said automatic disengagement of said sheet feeding nip sets is provided by automatically selectable rotation of said rotatable cams of selected said sheet feeding nip sets; and/or a sheet handling system wherein the sheet transport path has a sheet transport system and a skew correction system for deskewing image substrate sheets moving in a process direction in said sheet transport path by partially rotating selected said sheets for said deskewing thereof, said skew correction system being fed said sheets in said process direction by said sheet transport system in said sheet transport path, and wherein said image substrate sheets have a range of different sheet lengths in said process direction, the improvement in said sheet handling system for increasing said range of different sheet lengths which can be effectively deskewed by said skew correction system wherein; said sheet transport system comprises a plurality of sheet transport units spaced apart in said process direction from one another and from said skew correction system, said plurality of separate sheet transport units being independently engageable with a sheet being fed in said process direction in said sheet transport path for positively feeding said sheet from one said sheet transport unit to another and to said skew correction system, and being independently disengageable from said sheet for releasing said sheet; a plurality of selectable engagement systems operatively associated with respective said sheet transport units for independently selectably engaging and disengaging selected said sheet transport units; a sheet length signal generation system providing a sheet length control signal proportional to said length of said sheet in said sheet transport path; and a control system for automatically actuating a selected plurality of said selectable engagement systems to automatically disengage a selected plurality of said separate sheet transport units in response to said sheet length control signal when said sheet is in said skew correction system; and/or wherein each said separate sheet transport unit comprises plural transversely spaced sheet feeding nips, and wherein each said selectable engagement system for each said sheet transport unit comprises a single integral sheet feeding nips opening and closing system for all of said sheet feeding nips of said sheet transport unit; and/or wherein each said selectable engagement system for each said sheet transport unit comprises a single stepper motor and a single cam shaft rotatable by said stepper motor, said cam shaft having plural transversely spaced rotatable cams positioned to selectably operably engage said plural sheet feeding nips of said sheet transport unit by rotation of said cam shaft by said stepper motor; and/or wherein said sheet transport path is substantially planar and larger than the largest said sheet to be fed in said sheet transport path.

As is taught by the above-cited and many other references, the disclosed systems may be operated and controlled as described herein by appropriate operation of known or conventional control systems. It is well known and preferable to program and execute printing, paper handling, and other control functions and logic with software instructions for conventional or general purpose microprocessors, as taught by numerous prior patents and commercial products. Such programming or software may of course vary depending on the particular functions, software type, and microprocessor or other computer system utilized, but will be available to, or readily programmable without undue experimentation from, functional descriptions, such as those provided herein, and/or prior knowledge of functions which are conventional, together with general knowledge in the software and computer arts. Alternatively, the disclosed control system or method may be implemented partially or fully in hardware, using standard logic circuits or VLSI designs.

It is well known in the art that the control of sheet handling systems may be accomplished by conventionally actuating them with signals from a microprocessor controller directly or indirectly in response to programmed commands and/or from selected actuation or non-actuation of conventional switch inputs or sensors. The resultant controller signals may conventionally actuate various conventional electrical servo or stepper motors, clutches, or other components, in programmed steps or sequences.

In the description herein the term "sheet", "copy" or copy sheet" refers to a usually flimsy physical sheet of paper, plastic, or other suitable physical substrate for images, whether precut or initially web fed and cut.

As to specific components of the subject apparatus, or alternatives therefor, it will be appreciated that, as is normally the case, some such components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background. What is well known to those skilled in the art need not be described here.

Various of the above-mentioned and further features and advantages will be apparent from the specific apparatus and its operation described in the specific examples below. Thus, the present invention will be better understood from this description of these specific exemplary embodiments, including the drawing figures (approximately to scale) wherein.

Figure 2:
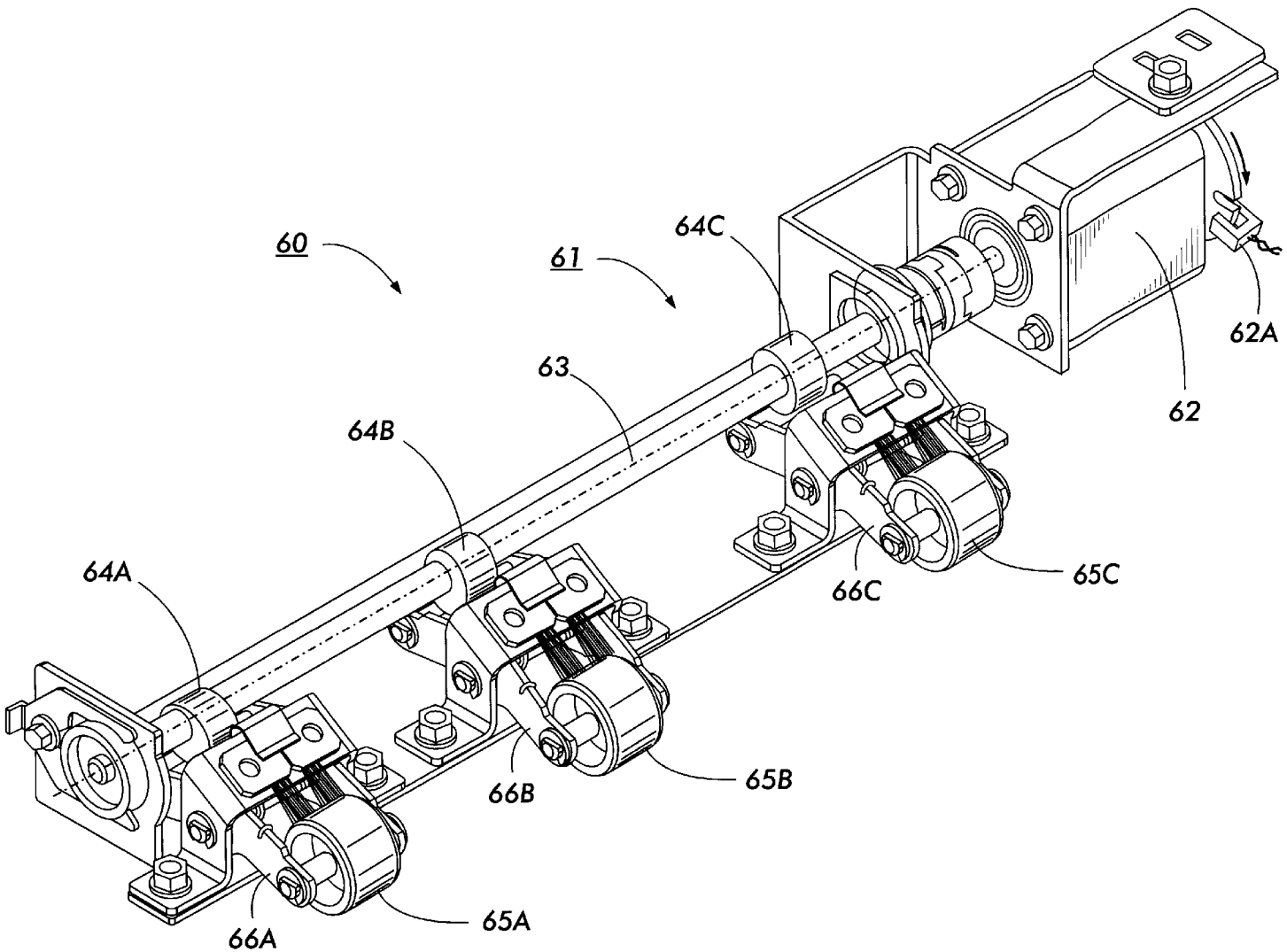
FIG. 2 is an overhead enlarged perspective view of an exemplary sheet deskewing unit per se which may be utilized with the exemplary automatically variable sheet system of the embodiment of FIG. 1.
Figure 7:
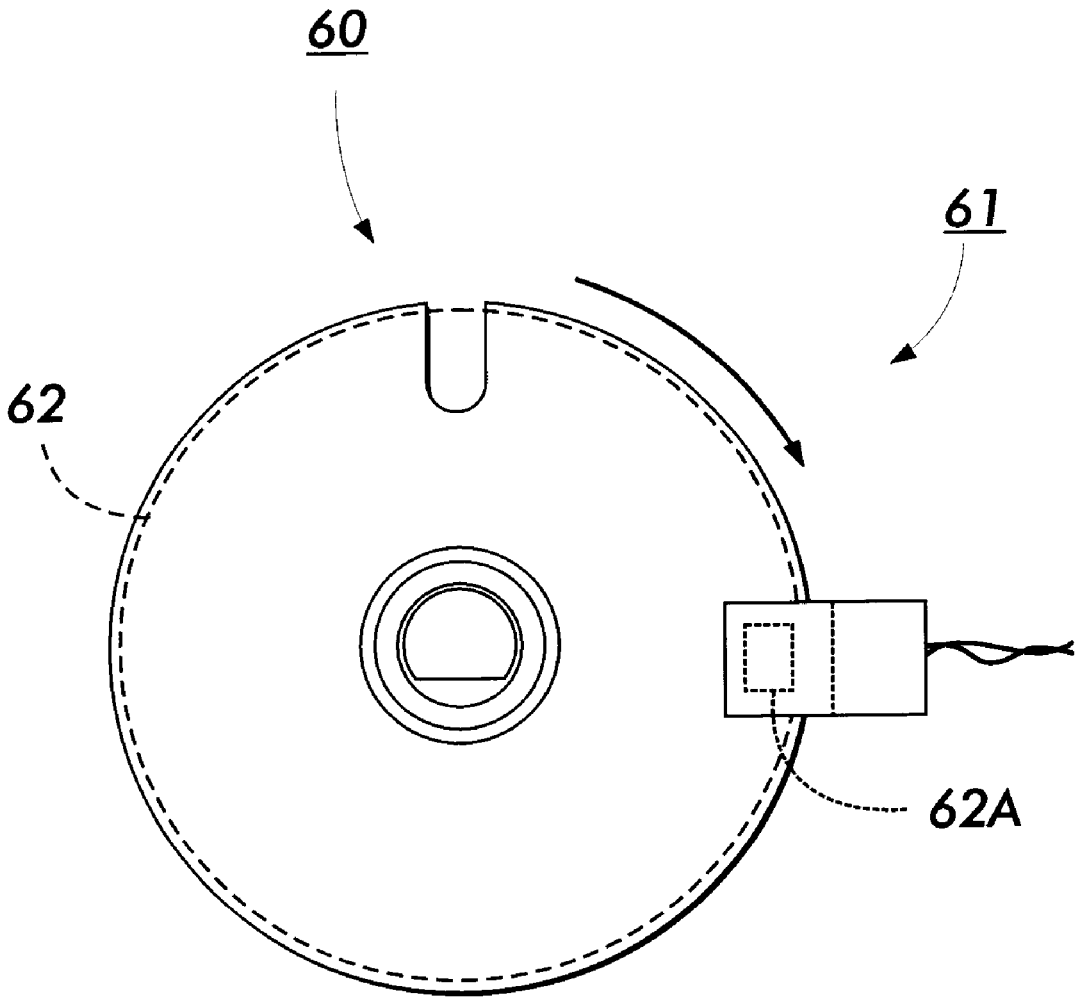
Figure 8:
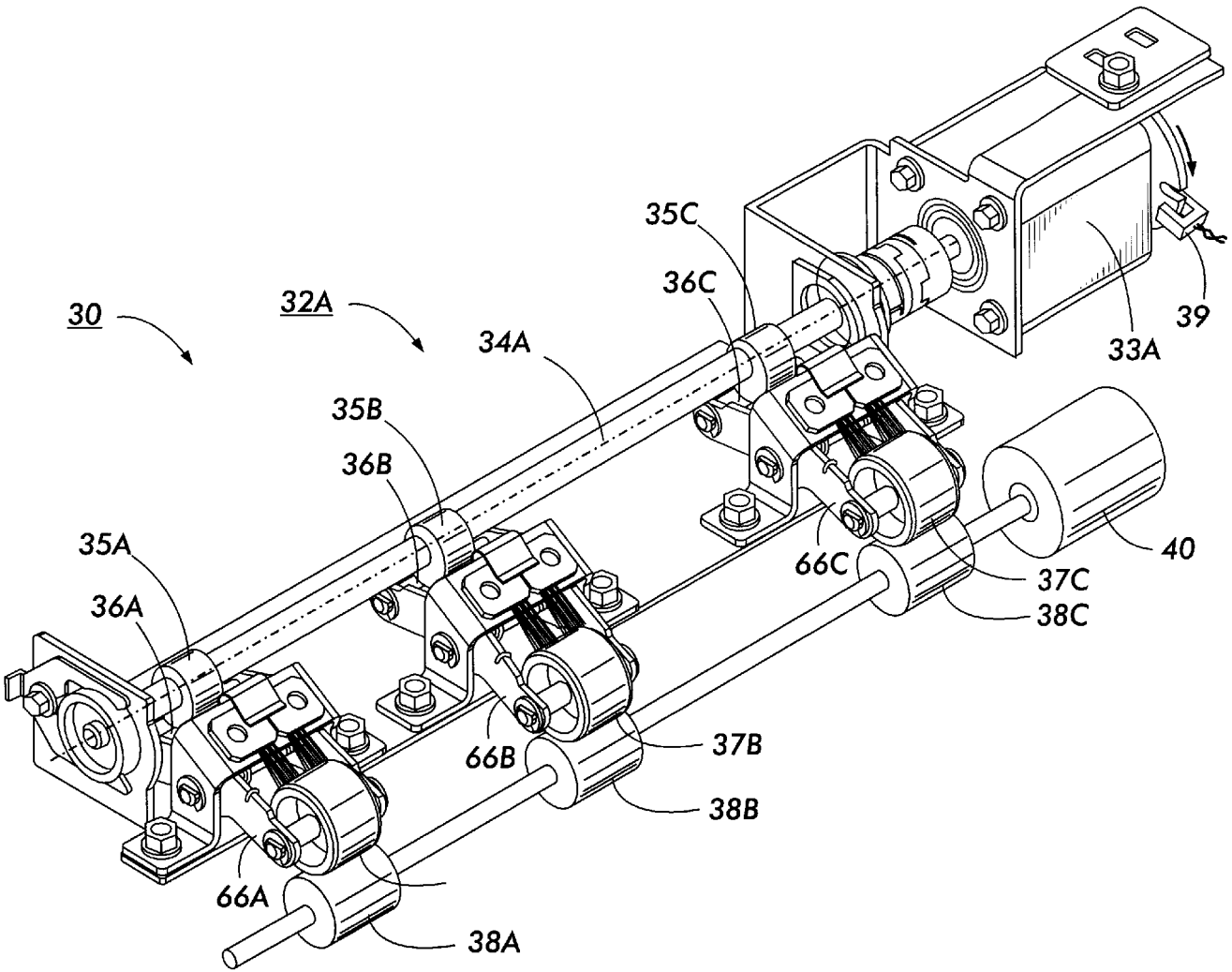

FIG. 7 is a simplified partial rear view of the unit of FIG. 2 showing an exemplary camshaft position sensing and control system {for illustration clarity the sensor is shown here and in other views at the 9:00 position, although both the sensor and the sensed notch or slot home positions are preferably at the 12:00 or top position}; and FIG. 8 is an overhead enlarged perspective view of one of the exemplary units of the three illustrated upstream sheet feeding units, plus its drive rollers system.

Figure 1:
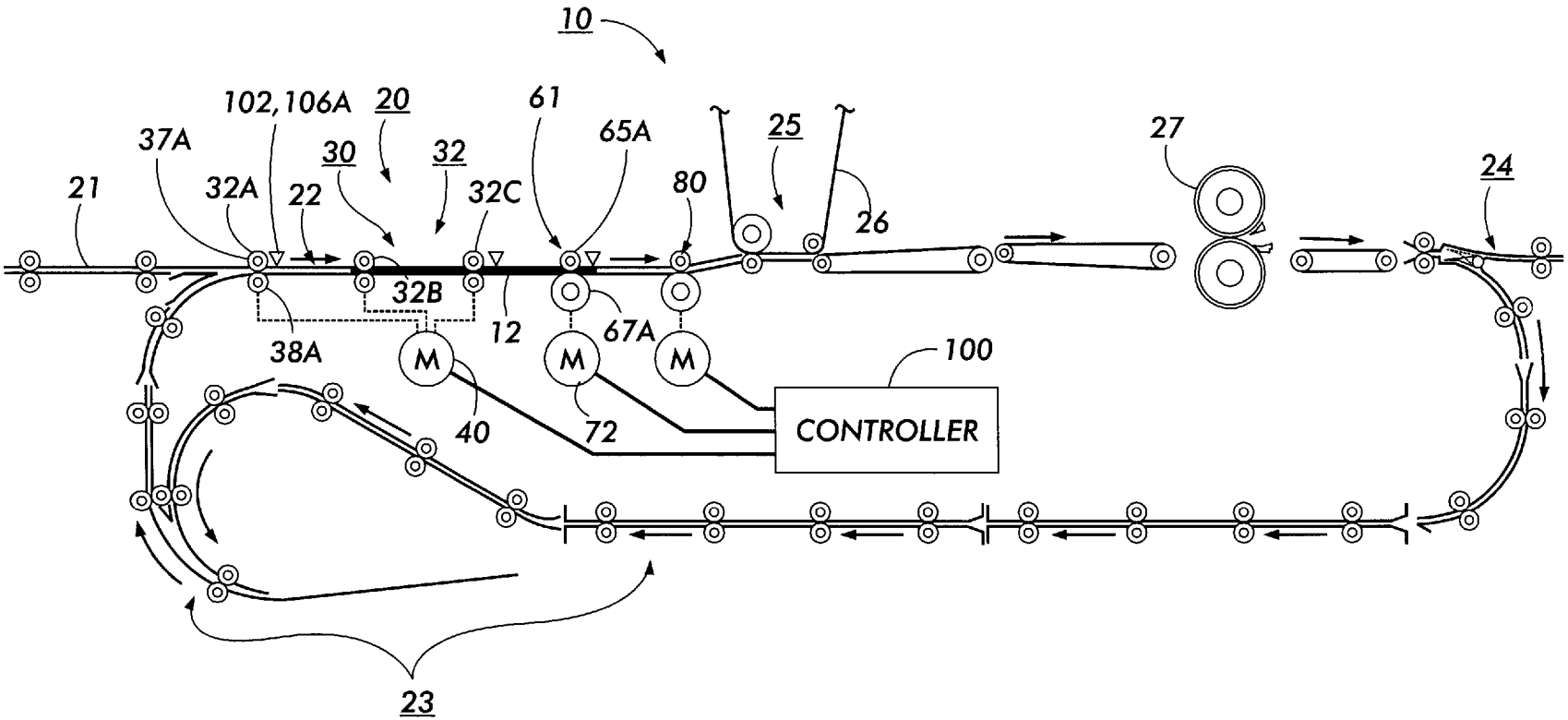
FIG. 1 is a schematic front view of one embodiment of the subject improved automatically variable sheet transport system for an automatic sheet deskewing system, comprising plural sheet feeding units shown here spaced along a sheet input path of a an exemplary high speed xerographic printer, so as to provide the capability of feeding and registering a wide range of different sheet sizes.

Described now in further detail, with reference to the Figs., is an exemplary embodiment of this application, and also an exemplary embodiment of the related, cooperative, above-cross-referenced application. There is shown in FIG. 1 one example of a reproduction machine 10 comprising a high speed xerographic printer merely by way of one example of various possible applications of the subject improved sheet deskewing and lateral shifting or registration system. As noted above, further details of the sheet deskewing and lateral registration system per se (before the optional improvements described herein) are already taught in the above-cited U.S. Pat. Nos. 5,678,159 and 5,715,514, and other cited art, and need not be re-described in detail here.

Referring to FIG. 1 in particular, in the printer 10, sheets 12 (image substrates) to be printed are otherwise conventionally fed through an overall paper path 20. Clean sheets to be printed are conventionally fed into a sheet input 21, which also conventionally has a converging or merged path entrance from a duplexing sheet return path 23. Sheets inputted from either input 21 or 23 are fed downstream here in an elongated, planar, sheet input path 21. The sheet input path 21 here is a portion of the overall paper path 20. The overall paper path 20 here conventional includes the duplexing return path 23, and a sheet output path 24 downstream from an image transfer station 25, with an image fuser 27 in the sheet output path. The transfer station 25, for transferring developed toner images from the photoreceptor 26 to the sheets 12, is immediately downstream from the sheet input path 21.

As will be described in detail later herein, in this embodiment this sheet input path 21 contains an example of a novel sheet 12 deskewing and side registration system 60 with an automatically variable lateral spacing nip engagement of its deskewing and side registration nips. This may be desirably combined with the subject upstream sheet feeding system 30 with a variable position sheet feeding nips engagement system 32.

Figure 3:
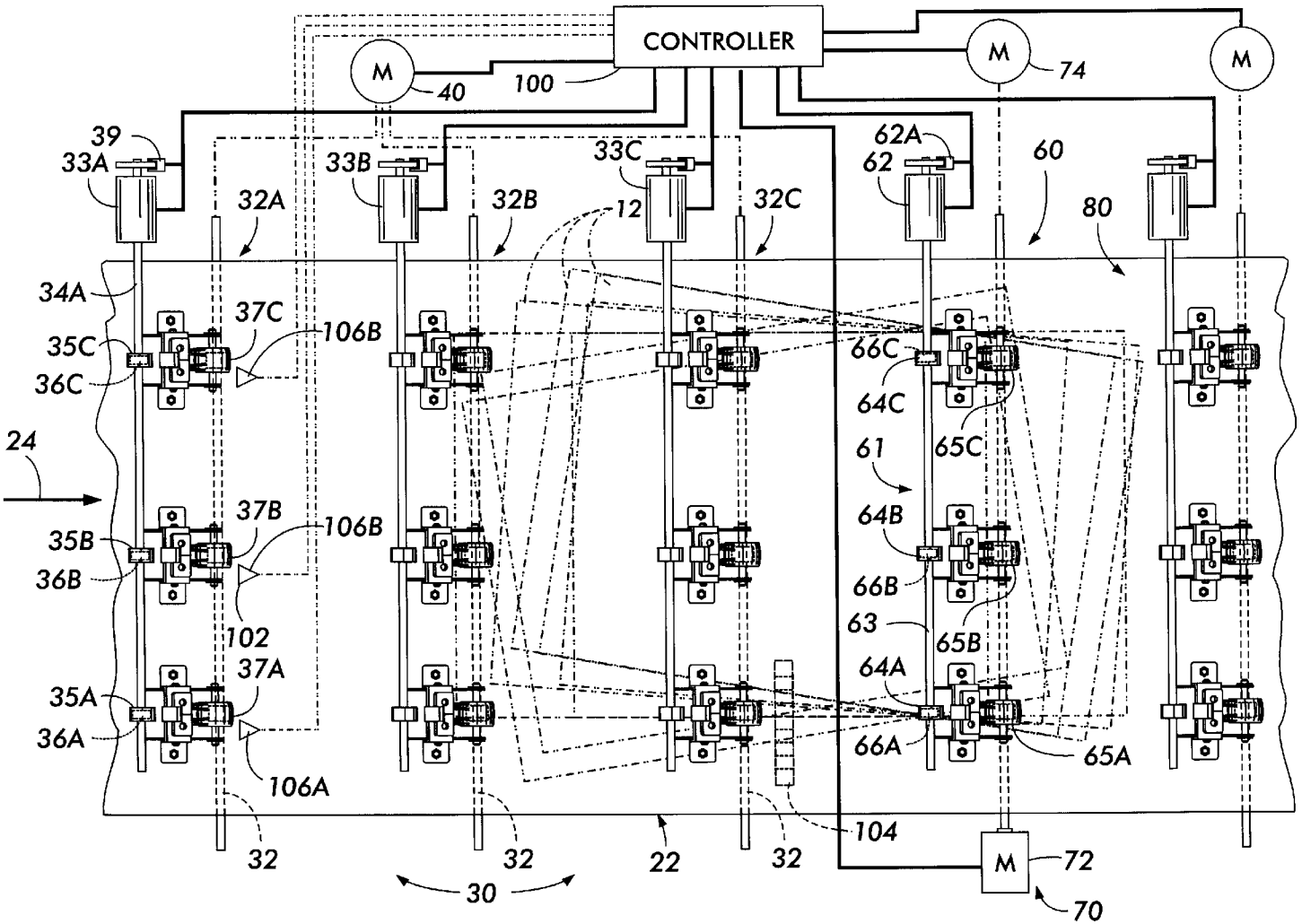
FIG. 3 is a schematic top view of the sheet input path of FIG. 1, showing the automatic plural independently engageable sheet feeding units and the sheet deskewing and side registration system of FIG. 1.

Describing first the subject exemplary sheet registration input system, referred to herein as the upstream sheet feeding system 30, its variable nips engagement system 32 here comprises three identical plural nip units 32A, 32B and 32C, respectively spaced along the sheet input path 21 in the sheet feeding or process direction, as shown in FIGS. 1 and 3, by relatively short distances therebetween capable of positively feeding the smallest desired sheet 12 downstream from one said unit 32A, 32B, 32C to another, and then from the nips of the last said unit 32C to the nips of the sheet deskewing and side registration system 60. Each said identical unit 32A, 32B, 32C, as especially shown in FIG. 8, has one identical stepper motor 33A, 33B, 33C, each of which is rotating a single identical cam-shaft 34A, 34B, 34C.

Since all three spaced units 32A, 32B, 32C may be identical in structure (i.e., identical except for their respective input control signals to their respective stepper motors 33A, 33B, 33C from the controller 100, to be described), only one said unit 32A, the furthest upstream, will now be described, with reference especially to FIG. 8. The camshaft 34A thereof extends transversely across the paper path and has three laterally spaced identical cams 35A, 35B, 35C thereon, respectively positioned to act on three identical spring-loaded idler lifters 36A, 36B, 36C, respectively mounting idler wheels 37A, 37B, 37C, whenever the camshaft 34A is rotated by approximately 90–120 degrees by stepper motor 33A. The stepper motor 33A or its connecting shaft may have a conventional notched disk optical "home position" sensor 39, as shown in FIGS. 7 and 8, and may be conventionally rotated by the desired amount or angle to and from that "home position" by application of the desired number of step pulses by controller 100. In that home position, all three cams lift and disengage all three of the respective identical idlers 37A, 37B, 37C above the paper path away from their normally nip-forming or mating sheet drive rollers 38A, 38B, 38C mounted and driven from below the paper path. All three of such paper path drive rollers 38A, 38B, 38C of all three of the units 32A, 32B, 32C may be commonly driven by a single common drive system 40, with a single drive motor (M), as schematically illustrated in FIGS. 1 and 3.

In the "home position" of the cams, as noted, all three sheet feeding nips are open. That is, the idler wheels 37A, 37B, 37C are all lifted up by the cams. When the idlers are released by the rotation of the cams they are all spring loaded down with a suitable normal force (e.g., about 3 pounds each) against their respective drive wheels 38A, 38B, 38C, to provide a transversely spaced non-slip, non-skewing, sheet feeding nip set. The transverse spacing of the three sheet feeding nips 37A/38A, 37B/38B, 37C/38C from one another may also be fixed, since it is such as to provide non-skewing sheet feeding of almost any standard width sheet. All three drive wheels 38A, 38B, 38C of all three of the units 32A, 32B, 32C may all be constantly driven at the same speed and in the same direction, by the common drive system 40.

For the variable operation of the upstream variable nip engagement sheet feeding system 32, the three units 32A, 32B, 32C are differently actuated by the controller 100 depending on the length in the process direction of the sheet they are to feed downstream to the deskew and side registration system 60. A sheet length control signal is thus provided in or to the controller 100. That sheet length control signal may be from a conventional sheet length sensor 102 measuring the sheet 12 transit time in the sheet path between trail edge and lead edge passage of the sheet 12 past the sensor 102. That sensor may be mounted at or upstream of the sheet input 21. Alternatively, sheet length signal information may already be provided in the controller from operator input or sheet feeding tray or cassette selection, or sheet stack loading therein, etc.

That sheet length control signal is then processed in the controller 100 to determine which of the three stepper motors 33A, 33B, 33C, if any, of the three units 32A, 32B, 32C spaced along the upstream sheet feeding input path 21 will be actuated for that sheet or sheets 12. None need to be actuated until the sheet 12 is acquired in the steering nips of the deskew and side registration system 60 (to be described). That insures positive nip sheet feeding of even very small sheets along the entire sheet input path 21.

For the shortest sheets, once the sheet is acquired in the steering nips of the deskew and side registration system 60, then only the most downstream unit 32C stepper motor 33C need be automatically actuated to rotate its cams to lift its idlers, in order to release that small sheet from any and all sheet feeding nips upstream of the unit 60, thus allowing the unit 60 to freely rotate and/or side shift the small sheet, as will be further described below. However, concurrently keeping the two other, further upstream, sheet feeding nip sets closed in the two further upstream units 32A, 32B, i.e., in their "home" positions, allows subsequent such small sheets to be positive fed downstream in the same input path closely following said released sheet.

However, the trailing end area of an intermediate length sheet will still be in the nip set of the intermediate sheet feeding unit 32B when its leading edge area reaches the nips of the deskewing and side registration system 60. Thus, when the sensor 102 or other sheet length signal indicates an intermediate sheet length being fed in the sheet input path 22, then both the units 32B and 32C are automatically actuated as described to disengage their nip sets at that point in time.

In further contrast, when a very long sheet is detected and/or signaled in the sheet input path 22, then when the lead edge of that long sheet has reached and is under feeding control of the deskewing and side registration system 60 all three units 32A, 32B, 32C are automatically actuated by the controller 100 to open all their sheet feeding nips to allow even such a very long sheet to be deskewed and side registered.

It will be appreciated that if an even greater range of sheet lengths is desired to be reliably input fed and deskewed and/or side registered (either clean new sheets or sheets already printed on one side being returned by the duplex loop return path 23 for re-registration before second side printing), the system 30 can be readily modified simply by increasing the number of spaced units, e.g., to allow even longer sheets to be deskewed by adding another identical feed nip unit to the system 32, spaced further upstream, and separately actuated depending on sheet length as described above. Added units may be spaced upstream by the same small-sheet inter-unit spacing as is already provided for feeding the shortest desired sheet between 32A, 32B, and 32C. For example, about 160 mm spacing between units (nips) in this example to insure positive feeding of sheets only 7" (176 mm) long in the process direction. In such an alternative embodiment with four upstream sheet feeding units, instead of opening the nip sets of from one to three units for deskewing in response to sheet length, the alternative system would be opening the nip sets of from one to four units. Likewise, if only a smaller range of sheet sizes is to be handled, there could be a system with only two units, 32B and 32C. In any version, the system 32 lends itself well to enabling a variable pitch, variable PPM rate, machine, providing increase productivity for smaller sheets, as well as handling much larger sheets, without skipped pitches.

An alternative embodiment for the selective feeding nip openings of the selected number sheet feeding units to be disengaged (not illustrated here but readily understandable), would be to have a single motor for all three or more units rotating a long shaft alongside or over the sheet path, extending past all three feeding units, which shaft is individually connectable to selected units by a conventional electromagnetic clutch for each unit connecting with a cam or other nip opening mechanism for that particular unit. The selected clutches of the selected units may be engaged while the stepper motor is in its rest or home position by applying the same above-described sheet length derived control signals from the same controller 100. The nips may be spring loaded closed automatically whenever their clutch's engagement current is released.

As another alternative version of the system 32, instead of waiting until the lead edge of a sheet reaches the deskew system 60 before opening the nips of any of the units 32A, 32B and 32C, the nips of each respective unit can be opened in sequence (instead of all at once) as the sheet being fed by one unit is acquired in the closed nips of the next downstream unit. The number of units needed to be held open to allow deskewing of long sheets will be the same described above, and the other units may have their nips re-closed for feeding in the subsequent sheet.

Turning now to the exemplary deskewing and side registration system 60, and to FIGS. 2 and 4–6 in particular, this comprises here a single unit 61 which may have virtually identical hardware components to the upstream units 32A, 32B, 32C, except for the important differences to be described below. That is, it may employ an identical stepper motor 62, home position sensor 62A, cam-shaft 63, spaced idlers 65A, 65B, 65C, and idler lifters 66A, 66B, 66C to be lifted by similar, but different, cams on a cam-shaft 63.

Additionally, and differently, the system 60 has sheet side edge position sensor 104 schematically shown in FIG. 3 which may be provided as described in the above-cited U.S.

Pat. Nos. 5,678,159 and 5,715,514 connecting to the controller 100 to provide differential sheet steering control signals for deskewing and side registering a sheet 12 in the system 60 with a variable drive system 70. The differential steering signals are provided to the variable drive system 70, which has two servo motors 72, 74. The servo motor 72 is independently driving an inboard or front fixed position drive roller 67A. [That is because this illustrated embodiment is a system and paper path which edge registers sheets towards the front of the machine, rather than rear edge registering, or center registering, which would of course have slightly different embodiments.] The other servo motor 74 in this embodiment is separately independently driving both of two transversely spaced apart drive rollers 67B and 67C, which may be coaxially mounted relative to 67A as shown. Thus, unlike said above-cited U.S. Pat. Nos. 5,678,159 and 5,715,514, there are three sheet steering drive rollers here, although only two are engaged for operation at any one time, as a single nip pair.

Figure 4:
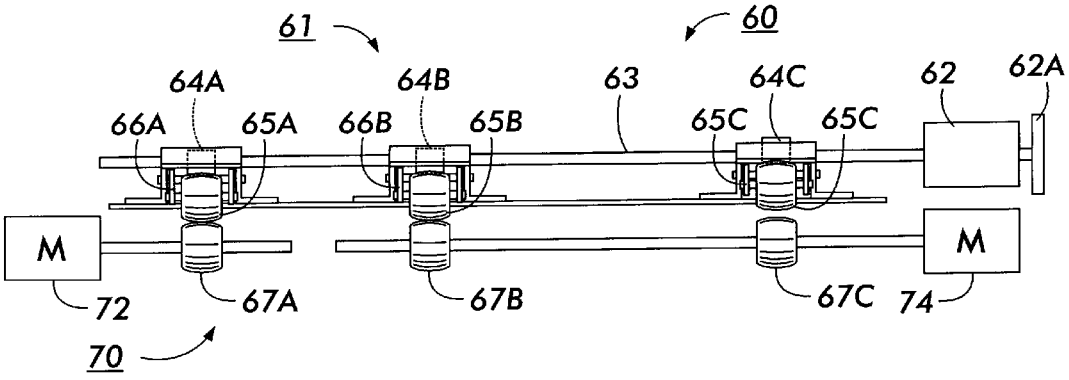
FIGS. 4, 5 and 6 are identical schematic side views of the deskewing unit of FIG. 2, respectively shown in three different operating positions; with FIG. 4 showing the two closest together steering nips closed for steering smaller sheets, FIG. 5 showing all three nips open (disengaged), and FIG. 6 showing the two furthest spaced apart nips engaged for steering larger sheets.
Figure 5:
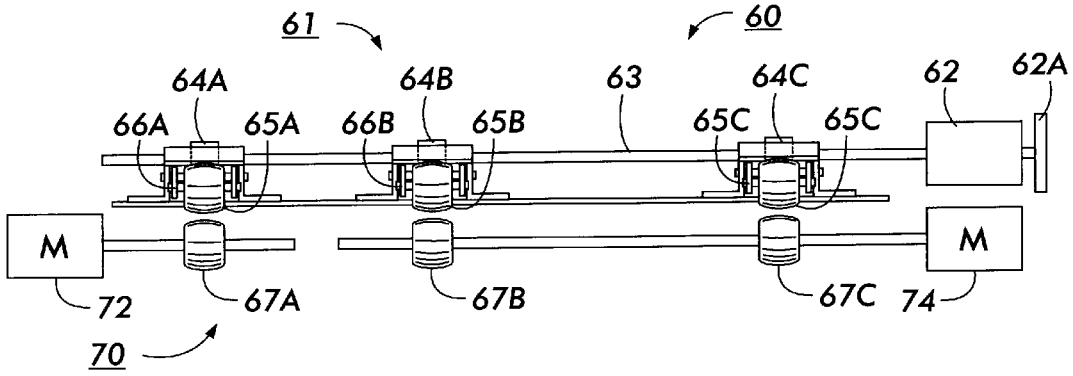
Figure 6:
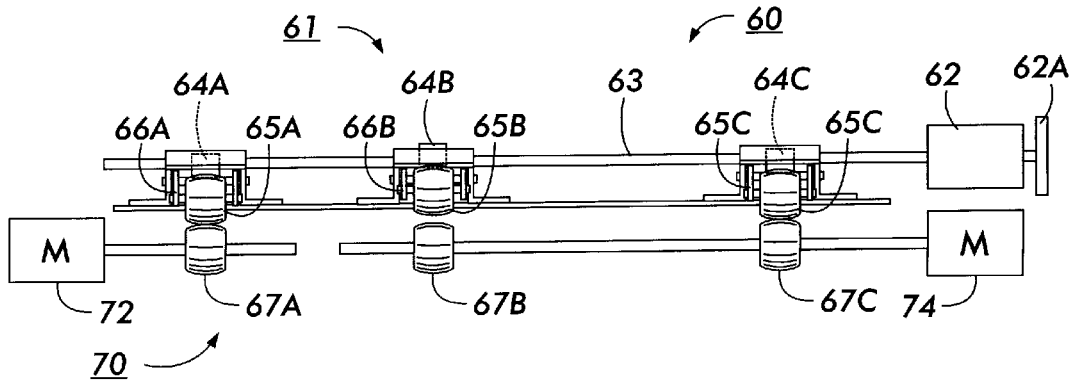

Here, in the system 60, as particularly illustrated in FIGS. 4–6, an appropriately spaced sheet steering nip pair is automatically selected and provided, among more than two different steering nips available, depending on the width of the sheet 12 being deskewed and side registered. For descriptive purposes here, the three differentially driven steering rollers of this embodiment may referred to as the inner or inboard position drive roller 67A, the intermediate or middle position drive roller 67B, and the outboard position drive roller 67C. They are respectively positioned under the positions of the spaced idlers 65A, 65B, 65C to form three possible positive steering nips therewith when those idlers are closed against those drive rollers, to provide two different possible pairs of such steering nips.

Additionally provided for the system 60 is a sheet width indicator control signal in the controller 100. Based on that sheet width input, the controller 100 can automatically select which two of said three steering nips 66A/67A, 66B/67B, 66C/67C, will be closed to be operative. In this example that is accomplished by opening and disengaging either steering nip 66B/67B or steering nip 66C/67C. That is accomplished here by a selected amount and/or direction of rotation of camshaft 63 by a selected number and/or direction of rotation step pulses applied to stepper motor 62 from its home position by controller 100, thereby rotating the respective cams 64A, 64B, 64C into respective positions for disengaging a selected one of the idlers 65A or 65B from its drive roller 67B or 67C. For example, the cams 64A 64B, 64C can be readily shaped and mounted such that in the home position all three steering nips are open.

The sheet width indication or control signal can be provided by any of various well known such systems, similar to that described above for a sheet length indication signal. For example, by three or more transversely spaced sheet width position sensors somewhere transverse the upstream paper path, or sensors in the sheet feeding trays associated with their width side guide setting positions, and/or from software look-up tables of the known relationships between known sheet length and approximate width for standard size sheets, etc. E.g., U.S. Pat. No. 5,596,399 and/or other art cited therein. As shown in FIGS. 1 and 3, an exemplary sheet length sensor 102 may be provided integrally with an exemplary sheet width sensor. In this example, a relative sheet width signal generation system with sufficient accuracy for this particular system 60 embodiment may be provided by a three sensor array 106A, 106B, 106C, respectively connected to the controller 100. Sheet length sensing may be provided by dual utilization of the inboard one, 106A, of those three sheet sensors 106A, 106B, 106C, shown here spaced across the upstream sheet path in transverse positions corresponding to the transverse positions of the 3 nips of the unit 61.

The operation of the system 60 varies automatically in response to the approximate sheet width, i.e., a sheet width determination of whether or not a sheet being fed into the three possible transversely spaced sheet steering nips (66A/67A, 66B/67B, 66C/67C) of the system 60 is so narrow that it can only be positively engaged by the inboard nip 66A/67A and (only) the intermediate nip 66B/67B, or whether the sheet being fed into the system 60 is wide enough that it can be positively engaged by both the inboard nip 66A/67A and the outboard nip 66C/67C as well as the intermediate nip.

A sheet sufficiently wide that it can be engaged by the much more widely spaced apart steering nip pair 66A/67A, 66C/67C is normally a much larger sheet with a greatly increased inertial and frictional resistance to rotation, especially if it is heavy and/or stiff, as well as having a long moment arm due to its extended dimensions from the steering nip. If the large sheet is also thin and flimsy, it can be particularly susceptible to wrinkling or damage. In either case, if the two steering nips are too closely spaced from one another, since they must be differently driven from one another to rotate the sheet for deskewing and/or side registration, it has been found that a large sheet may slip and/or be scuffed in the steering nips, and/or excessive nip normal force may be required. With the system 60, the transverse spacing between the operative nip pair doing the deskewing is automatically increased with an increase in sheet width, as described above, or otherwise, to automatically overcome or reduce these problems.

In this particular example, of a dual mode (two different steering nip pair spacings) system 60, for a sheet of standard letter size 11 inch width (28 cm) wide or wider, in the first mode a clockwise rotation of the stepper motor 62 from the home position (in which all three steering nips are held open by the cam lifters) to between about 90 to 120 degrees clockwise closes and renders operative the inner and outer steering nips and leaves the intermediate position steering nip open. For narrower sheets, in a second mode, counter-clockwise or reverse rotation of the stepper motor 62 from the home position to between about 90 to 120 degrees counter-clockwise closes the inner and intermediate steering nips by lowering their idlers 65A and 65B. That insures a steering nip pair spacing close enough together for both nips to engage a narrow sheet. That movement can also leave the outer steering nip open. Note that the inner cam 64A (of only this unit 61) is a differently shaped cam, which works to close that inner nip 65A/67A in both said modes here. With this specific dual mode operation, in this embodiment, the spacing between the inner nip and the intermediate nip can be about 89 mm, and the spacing between the inner nip and the outer nip can be about 203 mm.

It will be appreciated that the number of such selectable transverse distance sheet steering nips can be further increased to provide an even greater range of different steering nip pair spacings for an even greater range of sheet widths. Also, the nips may be slightly "toed out" at a small angle relative to one another to tension the sheet slightly therebetween to prevent buckling or corrugation, if desired. It has been found that a slight, one or two degrees, fixed mounting angle toe-out of the idlers on the same unit relative to one another and to the paper path can compensate for variations in the idler mounting tolerances and insure that the sheets will feed flat under slight tension rather than being undesirably buckled by idlers toed towards one another. For example, the outboard or first idler 37A nearest the side registration edge of each unit 32A, 32B, 32C may toed out toward that redge edge by that amount, and the two inboard or further idlers 37B and 37C of each unit may be toed inboard or away from the redge edge by that amount.

Also, the above-described planar and elongated nature of the entire input path 22 here allows even very large sheets to be deskewed without any bending or curvature of any part of the large sheet. That assists in reducing potential frictional resistance to deskewing rotation of stiff sheets from the beam strength of stiff sheets which would otherwise cause part of the sheet to press with a corresponding normal force against the baffles on one side or the other of the input path if that path were arcuate, rather than flat, as here.

After the sheet 12 has been deskewed and side registered in the system 60 it may be fed directly into the fixed, commonly driven, nip set of a downstream pre-transfer nip assembly unit 80. That unit 80 here feeds the sheet into the image transfer station 25. This unit 80 may also share essentially the same hardware as the three upstream sheet feeding units. Once the sheet 12 as been fed far enough on by the unit 80 to the position of the maximum tack point of electrostatic adhesion to the photoreceptor 26 within the transfer station 25, the nips of the unit 80 are automatically opened so that the photoreceptor 26 will control the sheet 12 movement at that point.

Note that the same pulse train of the same length or number of pulses can be applied by the controller 100 to all five of the stepper motors disclosed here to obtain the same nip opening and closing operations. Likewise, the same small holding current or magnetic holding torque may be provided to all the stepper motors to better hold them in their home position, if desired.

As to all of the units and their nip sets in the entire described input paper path, all of the nips may be opened by appropriate rotation of all the stepper motors for ease of sheet jam clearance or sheets removal from the entire path in the event of a sheet jam or a machine hard stop due to a detected fault.

Note that all the drive rollers and idlers here, even including the variable steering drive rollers 67A, 67B, 67C, can be desirably conventionally mounted and driven on fixed axes at fixed positions in the paper path. That is, none of the rollers or idlers need to be physically laterally moved or shifted even to change the sheet side registration position, unlike those in some other types of sheet lateral registration systems. Note that this entire paper path has only electronic positive nip engagement control registration, "on the fly", with no hard stops or physical edge guides stopping or engaging the sheets. The drive rollers may all be of the same material, e.g., urethane rubber of about 90 durometer, and likewise the idler rollers may all be of the same material, e.g., polycarbonate plastic, or a harder urethane. All of the sheet sensors and electronics other than the stepper motors may be mounted below a single planer lower baffle plate defining the input path 22, and that baffle plate can be hinged a one end to pivot down for further ease of maintenance.

While the embodiments disclosed herein are preferred, it will be appreciated from this teaching that various alternatives, modifications, variations or improvements therein may be made by those skilled in the art, which are intended to be encompassed by the following claims.

What is claimed is:

1. In a sheet handling method for correcting the skew of sequential image substrate sheets to be moved downstream in a process direction in a sheet transport path for a reproduction apparatus, in which selected said image substrate sheets are deskewed by being partially rotated by a sheet deskewing system, the improvement for increasing the operative range of effective deskewing of image substrate sheets of different lengths in said process direction, from a preset short sheet length to a very much greater sheet length, comprising:

obtaining a control signal proportional to said sheet length in said process direction of an image substrate sheet in said sheet transport path, providing a plurality of spaced apart sheet feeding nip sets of plural sheet feeding nips upstream from said sheet deskewing system in said sheet transport path, said plurality of spaced apart sheet feeding nip sets being spaced apart from one another and from said sheet deskewing system in said process direction by less than said preset short sheet length so as to be capable of providing positive sheet feeding of said preset short sheet lengths as well as longer sheet lengths in said process direction, sequentially positively feeding all of said image substrate sheets in said process direction downstream in said sheet transport path into said sheet deskewing system with said plurality of spaced apart sheet feeding nip sets, said plurality of spaced apart sheet feeding nip sets being selectably individually disengageable from an image substrate sheet moving in said process direction in said sheet transport path by opening said sheet feeding nips thereof, and automatically disengaging a selected plural number of said plurality of spaced apart upstream sheet feeding nip sets in response to said control signal proportional to said sheet length of said image substrate sheet moving in said process direction in said sheet transport path when said image substrate sheet is in said sheet deskewing system and before said image substrate sheet is deskewed by being partially rotated by said sheet deskewing system so that said upstream sheet feeding nip sets are disengaged from said image substrate sheet as said image substrate sheet is being deskewed, even for an image substrate sheet of said much greater sheet length, while a subsequent image substrate sheet moving in said process direction in said sheet transport path may be positively fed by at least one of said plurality of spaced apart sheet feeding nip sets.

2. The sheet handling method of claim 1, wherein all of said image substrate sheets are deskewed by being partially rotated while substantially planar.

3. The sheet handling method of claim 1, wherein said plural sheet feeding nips of said sheet feeding nip sets comprise plural drive wheels and plural mating idlers disengageable by plural rotatable cams, and wherein said automatic disengagement of said sheet feeding nip sets is provided by automatically selectable rotation of said rotatable cams of selected said sheet feeding nip sets.

4. The sheet handling method of claim 2, wherein said automatic disengagement of said sheet feeding nips is provided by a controlled partial rotation of a stepper motor rotating a cam shaft for rotating said cams.

5. In a sheet handling system for a sheet transport path of a reproduction apparatus, said sheet transport path having a sheet transport system and a skew correction system for deskewing image substrate sheets moving in a process direction in said sheet transport path by partially rotating selected said sheets for said deskewing thereof, said skew correction system being fed said sheets in said process direction by said sheet transport system in said sheet transport path, and wherein said image substrate sheets have a range of different sheet lengths in said process direction, the improvement in said sheet handling system for increasing said range of different sheet lengths which can be effectively deskewed by said skew correction system wherein:

said sheet transport system comprises a plurality of sheet transport units spaced apart in said process direction from one another and from said skew correction system, said plurality of separate sheet transport units being independently engageable with a sheet being fed in said process direction in said sheet transport path for positively feeding said sheet from one said sheet transport unit to another and to said skew correction system, and being independently disengageable from said sheet for releasing said sheet;

a plurality of selectable engagement systems operatively associated with respective said sheet transport units for independently selectably engaging and disengaging selected said sheet transport units;

a sheet length signal generation system providing a sheet length control signal proportional to said length of said sheet in said sheet transport path; and a control system for automatically actuating a selected plurality of said selectable engagement systems to automatically disengage a selected plurality of said separate sheet transport units in response to said sheet length control signal when said sheet is in said skew correction system;

wherein the number of said separate sheet transport units automatically disengaged in response to said sheet length control signal when said sheet is in said skew correction system is automatically increased in proportion to an increase in said sheet length.

6. The sheet handling system of claim 5, wherein said sheet transport path is substantially planar.

7. The sheet handling system of claim 5, wherein said plural separate sheet transport units are structurally identical to one another.

8. The sheet handling system of claim 5, wherein said sheet transport path is substantially planar and larger than the largest said sheet to be fed in said sheet transport path.

9. The sheet handling system of claim 5, wherein said skew correction system comprises a transversely spaced pair of independently driven steering nips engaging said sheet in said sheet path to rotate said sheet relative to said process direction for deskewing said sheet when no said sheet transport unit is engaging said sheet.

10. The sheet handling system of claim 5, wherein each said separate sheet transport unit comprises plural transversely spaced sheet feeding nips, and wherein each said selectable engagement system for each said sheet transport unit comprises a single integral sheet feeding nips opening and closing system for all of said sheet feeding nips of said sheet transport unit.

11. The sheet handling system of claim 10, wherein each said selectable engagement system for each said sheet transport unit comprises a single stepper motor and a single cam shaft rotatable by said stepper motor, said cam shaft having plural transversely spaced rotatable cams positioned to selectably operably engage said plural sheet feeding nips of said sheet transport unit by rotation of said cam shaft by said stepper motor.

* * * * *